US008212160B2

(12) United States Patent
Tsao

(10) Patent No.: US 8,212,160 B2
(45) Date of Patent: Jul. 3, 2012

(54) ELASTIC MEMBER AND KEY-PRESS ASSEMBLY USING THE SAME

(75) Inventor: Mei-Tsu Tsao, Tu-Cheng (TW)

(73) Assignee: Chi Mei Communications Systems, Inc., Tu-Cheng, New Taipei (TW)

( * ) Notice: Subject to any disclaimer, the term of this patent is extended or adjusted under 35 U.S.C. 154(b) by 264 days.

(21) Appl. No.: 12/624,826

(22) Filed: Nov. 24, 2009

(65) Prior Publication Data

US 2010/0307907 A1 Dec. 9, 2010

(51) Int. Cl.
*H01H 5/30* (2006.01)

(52) U.S. Cl. ..... 200/1 B; 200/406; 200/516

(58) Field of Classification Search ..... 200/1 B, 200/406, 516

See application file for complete search history.

(56) References Cited

U.S. PATENT DOCUMENTS 4,194,105 A * 3/1980 Hodges ..... 200/517
4,376,238 A * 3/1983 Martin ..... 200/513
5,717,176 A * 2/1998 Dahlstrom ..... 200/1 B
6,603,086 B2 * 8/2003 Kawaguchi et al. ..... 200/517
6,700,085 B2 * 3/2004 Teruyama et al. ..... 200/406
7,205,491 B2 * 4/2007 Kaizu et al. ..... 200/5 A
7,557,320 B1 * 7/2009 Crooijmans et al. ..... 200/406
2006/0016679 A1 * 1/2006 Kaizu et al. ..... 200/406
2007/0039811 A1 * 2/2007 Yanai et al. ..... 200/406

FOREIGN PATENT DOCUMENTS

CN 1906719 A 1/2007

* cited by examiner

*Primary Examiner* — Michael Friedhofer
(74) *Attorney, Agent, or Firm* — Altis Law Group, Inc.

(57) ABSTRACT

A key-press assembly includes a PCB, an elastic member and a key-press. The PCB forms a contact section on a surface thereof. The elastic member is configured to be mounted on the PCB corresponding to the contact section and includes a pressing portion, a first extension, a second extension, a connecting portion and a trigger portion. The first extension extends out from a circumference of the pressing portion. The second extension extends out from an outer boundary of the first extension parallel to the pressing portion. The electrical connecting portion extends out from a peripheral edge of the second extension and configured to be connected to the contact section. The trigger portion is formed at a junction of the first extension and the second extension correspondingly. The key-press is mounted on the elastic member for sandwiching the elastic member with PCB.

8 Claims, 6 Drawing Sheets

ELASTIC MEMBER AND KEY-PRESS ASSEMBLY USING THE SAME

BACKGROUND

1. Technical Field

The exemplary disclosure generally relates to an elastic member and key-press assembly using the elastic member.

2. Description of Related Art

Electronic devices typically have a keypad incorporated with a plurality of key-presses as an input terminal or a control button.

One such key-press assembly for a given electronic device typically includes a key-press and a dome shaped metallic elastic sheet, and a printed circuit board (PCB) defining a corresponding electric contact point. The key-press is mounted on the sheet over the contact point. In use, when the key-press is pressed, a bottom of the key-press deforms the sheet to touch the contact point. This configuration only allows the button to function in one way.

Therefore, there is room for improvement within the art.

BRIEF DESCRIPTION OF THE DRAWINGS

Many aspects of the exemplary elastic member and key-press assembly using the same can be better understood with reference to the following drawings. These drawings are not necessarily drawn to scale, the emphasis instead being placed upon clearly illustrating the principles of the present elastic member and key-press assembly using the same. Moreover, in the drawings like reference numerals designate corresponding parts throughout the at least one views. Wherever possible, the same reference numbers are used throughout the drawings to refer to the same or like elements of an embodiment.

DETAILED DESCRIPTION

Figure 1:
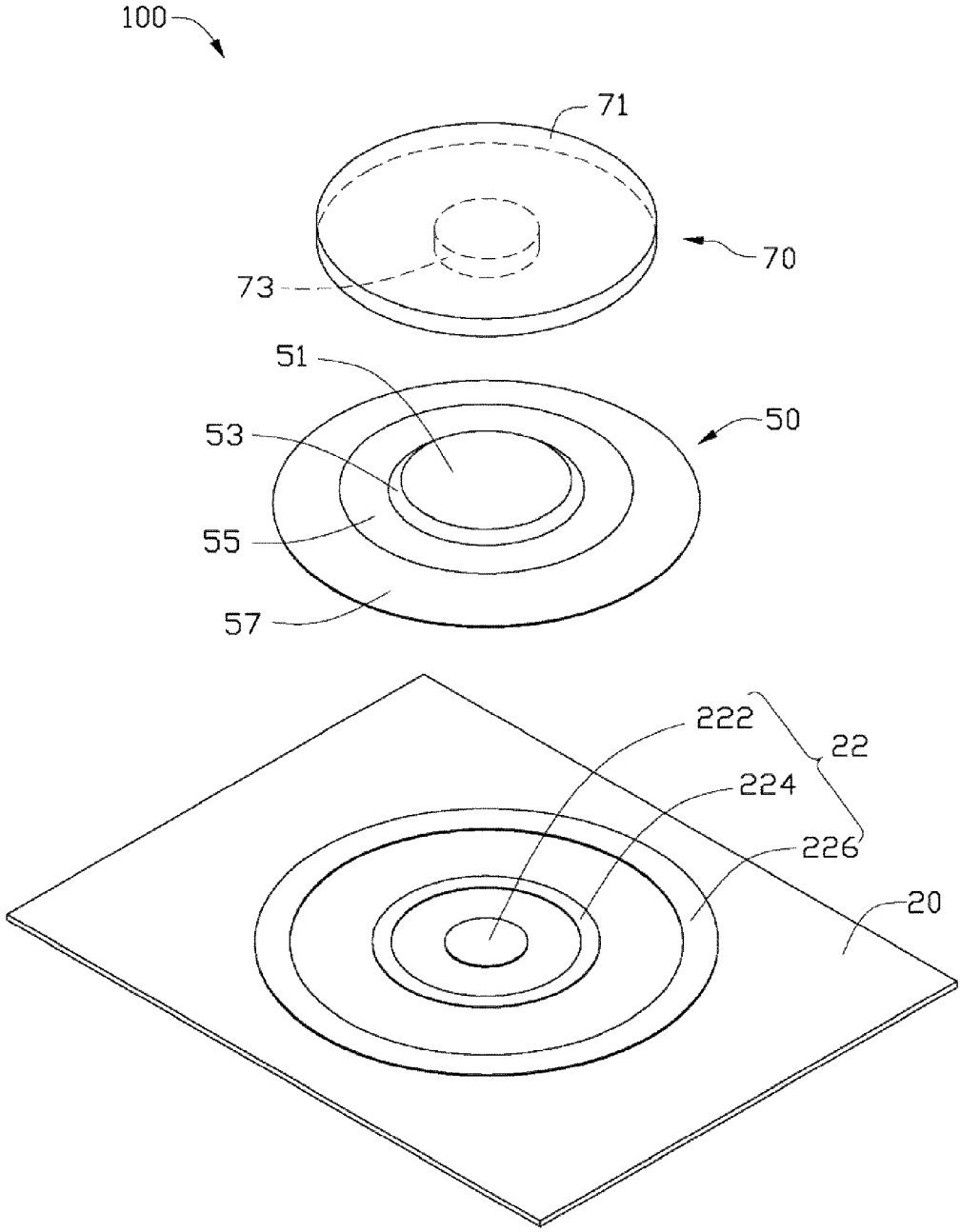
FIG. 1 shows a disassembled perspective view of a key-press assembly incorporating an elastic member, according to an exemplary embodiment.

FIG. 1 shows a disassembled perspective view of a key-press assembly 100 incorporating an elastic member 50, according to an exemplary embodiment. The key-press assembly 100 is suitable for a portable electronic device e.g. a mobile telephone, a personal digital assistant (PDA), a digital camera etc. The key-press assembly 100 includes a printed circuit board (PCB) 20, an elastic member 50, and a key-press 70. The PCB 20 includes an electrical contact section 22 formed on a surface thereof corresponding to the elastic member 50. The contact section 22 includes a first electrical contact section 222, a second electrical contact section 224, and a third electrical contact section 226, all spaced apart from each other. In the present embodiment, the contact section 22 is an electro-conductive coating. The first contact section 222 has a substantially circular shape. The second contact section 224 and the third electrical contact section 226 are substantially ring shape, encircling the first electric contact 22 and coaxial with the first electrical contact section 222.

The elastic member 50 has a substantially stepped hollow dome shape, and is configured to be mounted on the PCB 20 at a position corresponding to the contact section 22 and elastically sandwiched between the key-press 70 and the PCB 20. The elastic member 50 is made of electro-conductive material, such as metal, for example. The elastic member 50 includes a pressing portion 51, a first extension 53, a second extension 55, and a connecting portion 57. The pressing portion 51 has a substantially disk shape corresponding to the key-press 70 and the first electrical contact section 222 of the PCB 20. The pressing portion 51 includes at least one contact terminals 511 (shown in FIG. 3) disposed on a surface thereof facing the first electrical contact section 222 of the PCB 20. The first extension 53 is a substantially annular inclined wall extending outwards from a peripheral circumference of the pressing portion 51 toward the side of the pressing portion 51 having the contact terminal 511. In the exemplary embodiment, the first extension 53 forms an obtuse angle $\alpha$ with the pressing portion 51. Preferably, the obtuse angle $\alpha$ between the first extension 53 and the pressing portion 51 is greater than or equal to about 135 degrees. The second extension 55 is a substantially ring sheet shape, and extends outwards from an outer boundary of the first extension 53 parallel with the pressing portion 51. Thereby a trigger portion 54 is formed at a junction of the first extension 53 and the second extension 55 corresponding to the second electrical contact section 224 of the PCB 20. The connecting portion 57 is a substantially annular inclined wall extending out from a peripheral edge of the second extension 55 on the same side of the pressing portion 51 as the first extension 53. The connecting portion 57 forms an obtuse angle $\beta$ with the second extension 55. Preferably, the obtuse angle $\beta$ between the connecting portion 57 and the second extension 55 is slightly greater than the angle $\alpha$ for facilitating pressing the elastic member 50.

Figure 2:
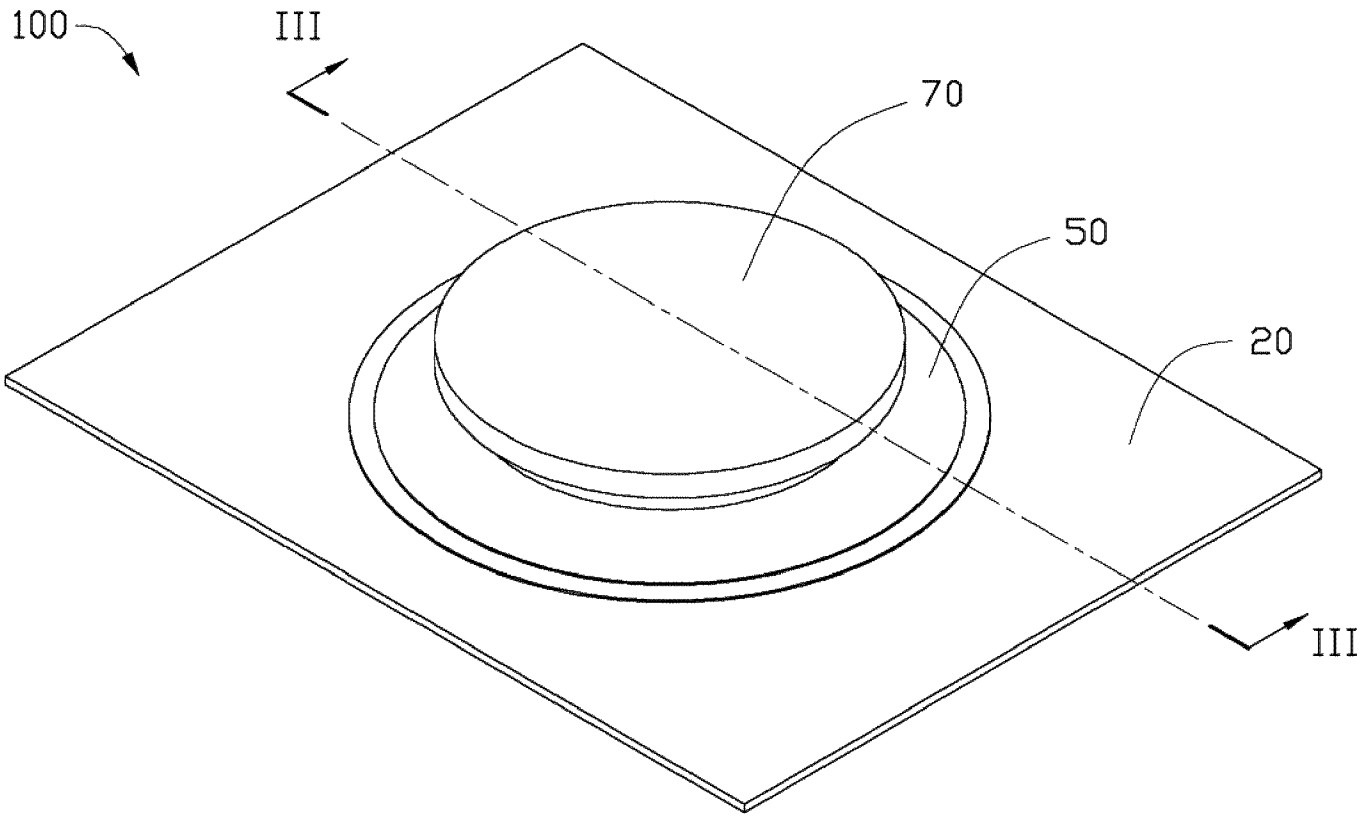
FIG. 2 shows an assembled perspective view of the key-press assembly shown in FIG. 1.
Figure 3:
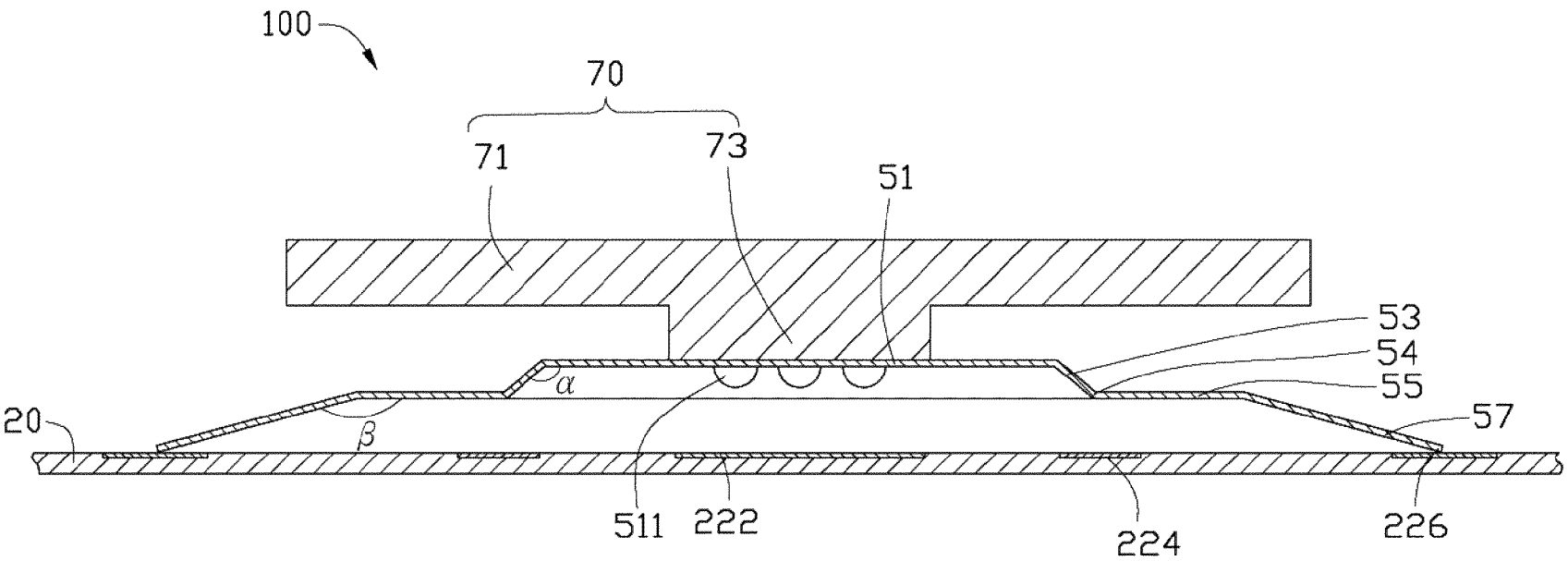
FIG. 3 shows a cross-sectional view taken along line III-III of FIG. 2.

Also referring to FIG. 2 and FIG. 3, the key-press 70 has a substantially stepped cylinder shape. The key-press 70 includes a pressing end 71 and a resisting end 73 projecting from the pressing end 71. In assembly, the elastic member 50 is mounted on the PCB 20. The connecting portion 57 is electrically connected and fixed to the corresponding third electrical contact section 226 of the PCB 20. The contact terminals 511 of the pressing portion 51 are positioned to correspond to the first electrical contact section 222. The trigger portion 54 of the elastic member 50 is located to correspond to the second electrical contact section 224 of the PCB 20. After that, the key-press 70 is mounted on the elastic member 50, with the resisting end 73 fixed to the pressing portion 51. Thus, the elastic member 50 is tightly sandwiched between the key-press 70 and the PCB 20.

Figure 4:
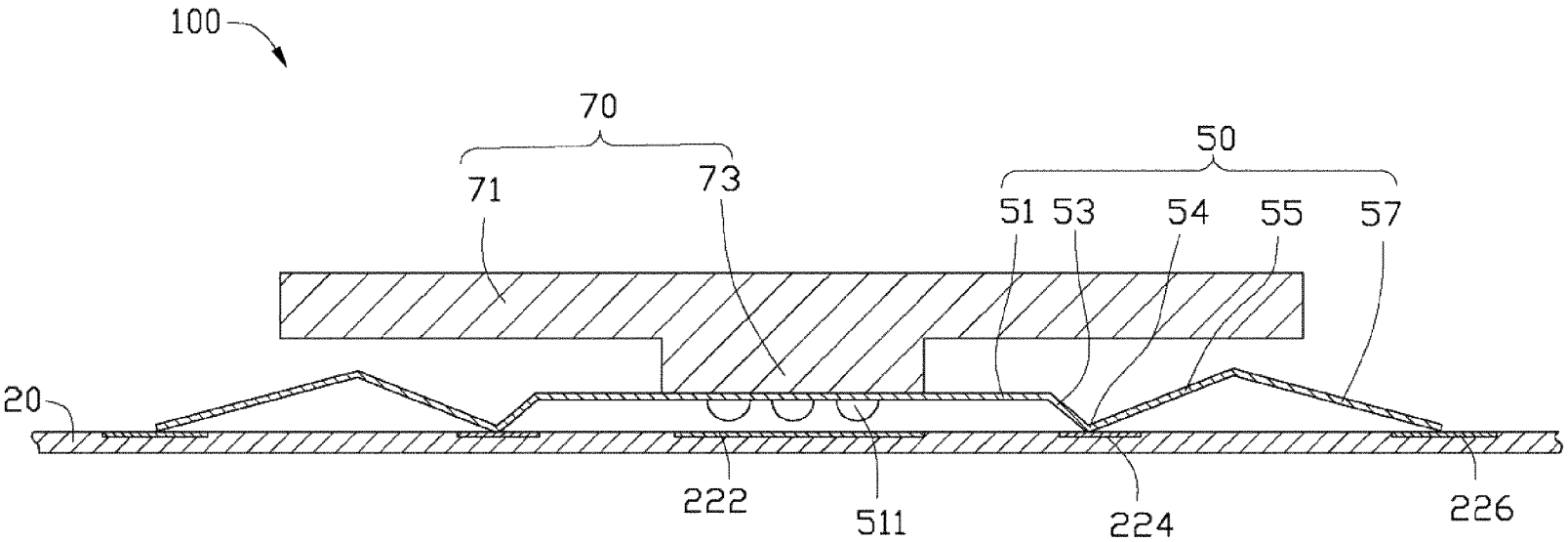
FIG. 4 is similar to FIG. 3, showing a cross-sectional view of the key-press assembly, wherein, the key-press is pressed downward in a first position.
Figure 5:
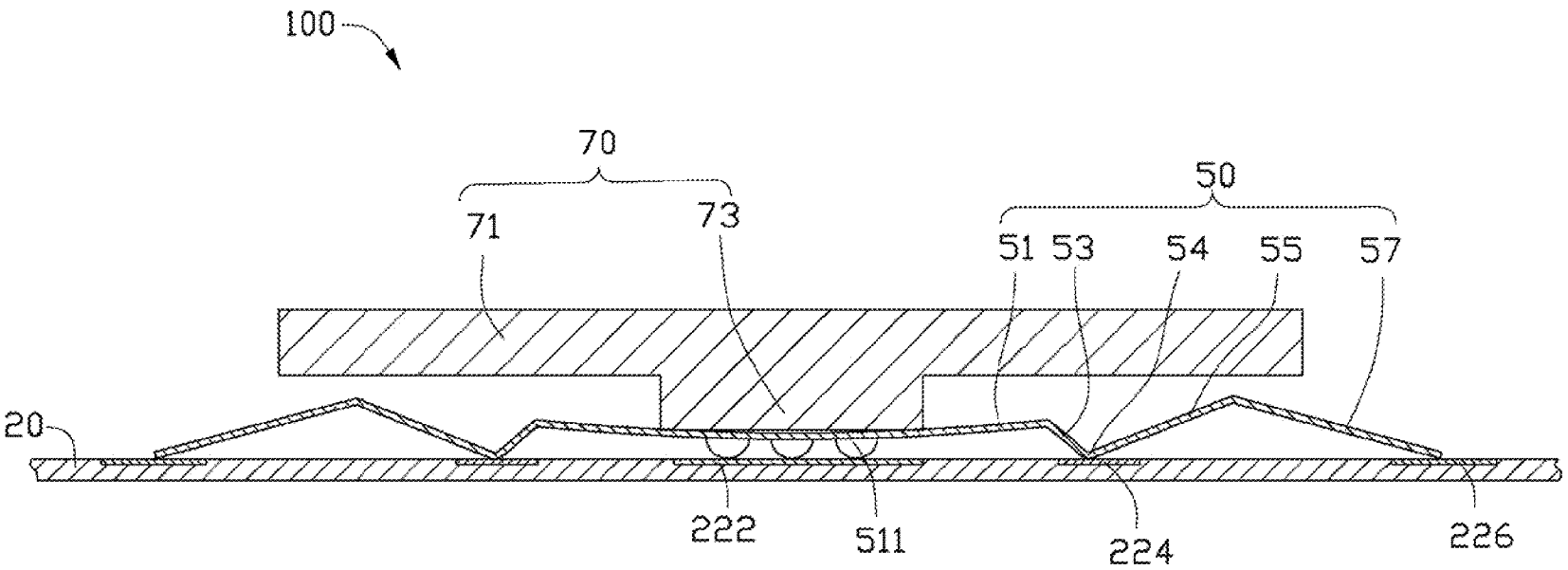
FIG. 5 shows a cross-sectional view of the key-press assembly, wherein, the key-press is pressed downward completely in a second position.

In use, referring to FIG. 4 and FIG. 5, when a user presses the pressing end 71 of the key-press 70 toward the PCB 20, the resisting end 73 of the key-press 70 pushes the corresponding pressing portion 51 of the elastic member 50 toward the PCB 20. The first extension 53 and the second extension 55 are pushed toward the PCB 20. The first extension 53 and the second extension 55 deform and accumulate elastic energy. The trigger portion 54 will electrically contact the corresponding second electrical contact section 224 of the PCB 20, and thus, the second electrical contact section 224 and the third electrical contact section 226 are electrically connected to generate a first electronic control signal that may be used to trigger a first function of the electronic device. After that, pressing of the pressing end 71 of the key-press 70 may be continued until the contact terminals 511 of the pressing portion 51 electrically contact the corresponding first electrical contact section 222 of the PCB 20, and thus, the first electrical contact section 222, the second electrical contact section 224, and the third electrical contact section 226 are electrically connected to generate a second electronic control signal to that a second function of the electronic device may be triggered. When the pressing end 71 of the key-press 70 is released, the pressing portion 51, the first extension 53, and the second extension 55 of the elastic member 50 return back to their original states due to the stored elastic energy of the elastic member 50.

Due to the special structure of the elastic member 50 of the exemplary key-press assembly 100, the key-press assembly 100 can be operated to trigger more than one function of the electronic device.

Figure 6:
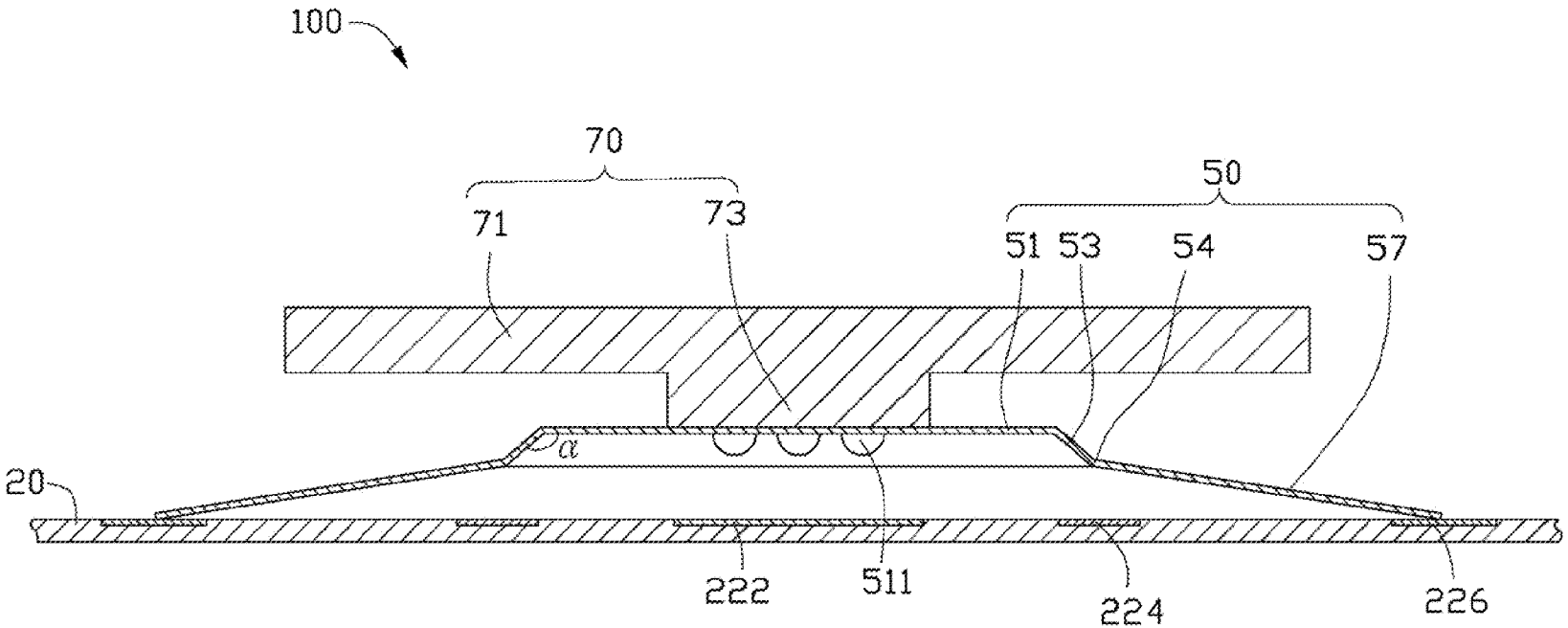
FIG. 6 shows a cross-sectional view of the key-press assembly incorporating an elastic member, according to a second exemplary embodiment of the present disclosure.

Referring to FIG. 6, a cross-sectional view of the key-press assembly 100 incorporating an elastic member 50, according to a second exemplary embodiment of the present disclosure is shown. The key-press assembly 100 shown in FIG. 6 is similar to FIG. 3, the difference therebetween is that the second extension 55 is omitted, and thus, the connecting portion extends out from the peripheral edge of the first extension 53 on the same side of the pressing portion 51 as the first extension 53. The trigger portion 54 is formed at the junction of the first extension 53 and the connecting portion 57 corresponding to the second electrical contact section 224 of the PCB 20.

It is to be understood, however, that even through numerous characteristics and advantages of the present disclosure have been set forth in the foregoing description, together with details of the structure and function of the disclosure, the disclosure is illustrative only, and changes can be made in detail, especially in matters of shape, size, and arrangement of parts within the principles of the disclosure to the full extent indicated by the broad general meaning of the terms in which the appended claims are expressed.

What is claimed is:

1. An elastic member comprising:

a flat pressing portion with at least one contact terminal disposed on a surface thereof;

a first extension extending out from a periphery of the pressing portion toward to the contact terminal side of the pressing portion;

a second extension extending out from a periphery of the first extension and parallel to the pressing portion;

an electrical connecting portion extending out from a corresponding peripheral edge of the second extension; and a trigger portion formed at a junction of the first extension and the second extension.

2. The elastic member as claimed in claim 1, wherein the first extension forms a first obtuse angle with the pressing portion; the connecting portion forms a second obtuse angle, slightly greater than the first obtuse angle, with the second extension.

3. A key-press assembly comprising:

a PCB having a contact section on a surface thereof;

an elastic member configured to be mounted on the PCB at a position corresponding to the contact section, comprising:

a flat pressing portion with at least one contact terminal disposed on a surface thereof;

a first extension extending out from a periphery of the pressing portion toward to the contact terminal side of the pressing portion;

a second extension extending out from a periphery of the first extension and parallel to the pressing portion;

an electrical connecting portion extending out from a corresponding peripheral edge of the second extension and electrically connected and fixed to the contact section; and a trigger portion formed at a junction of the first extension and the second extension correspondingly; and a key-press mounted on the elastic member for sandwiching the elastic member with PCB, the key-press being substantially stepped cylinder shape and including a pressing end and an opposite resisting end coaxially connected each other, the pressing end having a larger area than the resisting end, the resisting end mounted on the flat pressing portion.

4. The key-press assembly as claimed in claim 3, wherein the contact section includes a first electrical contact section, a second electrical contact section, and a third electrical contact section, all spaced from each other and corresponding to the contact terminals of the pressing portion, the trigger portion and connecting portion respectively; the connecting portion electrically connected to third electrical contact section of the PCB.

5. The key-press assembly as claimed in claim 4, wherein the contact section is an electro-conductive coating, the first electrical contact section is substantially circular shape; the second electrical contact section and the third electrical contact section are both substantially ring shape, encircling and coaxial with the first electric contact section.

6. The key-press assembly as claimed in claim 5, wherein the first extension forms a first obtuse angle with the pressing portion; the connecting portion forms a second obtuse angle, slightly greater than the first obtuse angle, with the second extension.

7. The key-press assembly as claimed in claim 5, wherein the obtuse angle $\alpha$between the first extension and the pressing portion is greater than or equal to about 135 degrees.

8. The key-press assembly as claimed in claim 5, wherein the elastic member is substantially stepped hollow dome shaped.

* * * * *